United States Patent [19]

Roberts

[11] Patent Number: 4,530,127

[45] Date of Patent: Jul. 23, 1985

[54] THREAD CLEANING DEVICE

[76] Inventor: Royce G. Roberts, P.O. Box 1296, Kenai, Ak. 99611

[21] Appl. No.: 414,989

[22] Filed: Sep. 3, 1982

Related U.S. Application Data

[63] Continuation of Ser. No. 197,895, Oct. 17, 1980, abandoned.

[51] Int. Cl.[3] ..... B08B 9/02

[52] U.S. Cl. ..... 15/104.04; 15/104.09; 15/88; 29/81 H

[58] Field of Search ..... 15/88, 104.1 R, 104.03, 15/104.04, 104.05, 104.09; 29/81 F, 81 H, 81 J; 408/35

[56] References Cited

U.S. PATENT DOCUMENTS

| | | | |
|---|---|---|---|
| 2,682,698 | 7/1954 | Berthiez | 408/35 X |
| 4,011,617 | 3/1977 | Toelke et al. | 15/88 |
| 4,014,062 | 3/1977 | Scott et al. | 15/104.04 |
| 4,372,003 | 2/1983 | Toelke | 15/88 |
| 4,403,363 | 9/1983 | Hess | 15/104.04 |

*Primary Examiner*—Z. R. Bilinsky

*Attorney, Agent, or Firm*—Marcus L. Bates

[57] ABSTRACT

A tool having opposed cleaning heads for sequentially engaging and cleaning the opposed threaded ends of pipe joints. A pipe end is engaged and cleaned by a brush located on one of the cleaning heads. The pipe is moved longitudinally to position the remaining threaded end near the other cleaning head. The tool is manipulated to position the other cleaning head in contact with the remaining threaded end so that both the box and pin end of a pipe joint can be rapidly and efficiently cleaned.

6 Claims, 16 Drawing Figures

THREAD CLEANING DEVICE

REFERENCE TO RELATED PATENT APPLICATIONS

This patent application is a continuation of patent application Ser. No. 197,895 filed Oct. 17, 1980 (now abandoned); which in turn is a continuation of patent application Ser. No. 965,908 filed Dec. 4, 1978, now U.S. Pat. No. 4,262,410.

BACKGROUND OF THE INVENTION

When pipe is transferred from one geographical location to another, the threads thereof must be protected against damage which might result from handling and from the deleterious effects of the ambient. Oilfield pipe, especially drill pipe and production tubing, may be handled many times during its life, and the removal and replacement of the thread protectors at each end of the pipe joints requires a substantial amount of labor.

When the joints of pipe are transferred longitudinally along the axial centerline thereof; for example, as the pipe is being manufactured, or as the pipe is being electronically inspected; the ends of the pipe are disposed such that ready access may be had to the protector device located on either end thereof. It would therefore be desirable to be able to economically and efficiently remove or attach the protectors on either end of the pipe, as the pipe is being conveyed during either of these processes.

It would also be desirable to clean the threaded box and pin ends of the pipe during the above process, and thereafter measure the uniformity of the interior of the pipe to assure that the inside diameter is of a minimum value.

Such a desirable expedient is the subject of this invention.

SUMMARY OF THE INVENTION

A tool for rotating co-acting threaded members to enable the members to be made up and broken out respective to one another. The tool comprises a plurality of circumferentially spaced-apart jaw means for releasably engaging and rotating one of the co-acting threaded members.

A first and a second plurality of arm members are arranged for moving the jaw means radially towards one another and into gripping contact with the threaded member. The arm members are attached to first and second rotatable mount members which impart rotational motion into the jaw members. The first and second rotatable mount members are movable towards and away from one another.

One end of each arm member is journaled to one of the jaw means. The other end of the first plurality of arm members is journaled to the first rotatable mount member, while the other end of the second plurality of jaw members is journaled to the second rotatable mount member. The first and second rotatable members are mounted to the marginal end of a motor-driven rotatable shaft, with the first mount member being arranged to be reciprocated along a marginal, medial portion of the shaft. Means attached to structure associated with the motor moves the first rotatable member towards and away from the second rotatable member, thereby causing the arms to move the jaws toward and away from one another.

In a more specific form, the first plurality of arms are arranged such that parallel pairs of arms have the ends thereof connected between the second mount member and the jaws, thereby causing the jaws to remain orientated in the same direction as the jaws move toward and away from one another. Another arm interconnects the jaws to the first rotatable member so that movement between the first and second rotatable members imparts pivotal motion into the parallel arms.

In another embodiment of the invention, the main frame is connected to be moved laterally away from the longitudinally traveling pipe and then the tool is rotated 180° in a vertical plane which lies along the longitudinal axial centerline of the pipe. The tool is thereby repositioned to engage and remove the remaining protector from the pin end of the pipe.

In still another embodiment of the invention, a cleaning head is mounted in cooperative relationship respective to the main frame with the cleaning head being axially aligned with the end of one pipe while the jaws of the tool are aligned with the end of an adjacent pipe. The cleaning head engages and cleans the threads of one pipe end simultaneously with the removal of a protector device from the end of an adjacent pipe.

In still a further embodiment of the invention, a gauging tool is positioned to be telescopingly received within a pipe as the pipe travels away from the tool, thereby assuring that the pipe interior is of a predetermined minimum value.

Accordingly, a primary object of the present invention is the provision of apparatus for rotating co-acting threaded members to enable the members to be made up and broken out respective to one another.

A further object of the present invention is the provision of method and apparatus by which couplings and pipe protectors and the like may be removed from or threadedly made up to the end of a joint of pipe while simultaneously cleaning the threaded pipe ends.

A still further object of this invention is the provision of a machine for releasably engaging and turning a threaded member.

Another and still further object of the present invention is the provision of method and apparatus by which a threaded member can be removed from either end of a joint of pipe, while another threaded end of a pipe is being cleaned.

An additional object of this invention is the provision of an apparatus for removing pipe protectors from the threaded ends of a joint of pipe.

A further object of this invention is the provision of a machine having a shaft-mounted, rotating head assembly with radially-spaced jaws being moved toward and away from one another by manipulation of the head assembly so that the jaws can releasably engage and rotate a rotatable member.

These and various other objects and advantages of the invention will become readily apparent to those skilled in the art upon reading the following detailed description and claims and by referring to the accompany drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
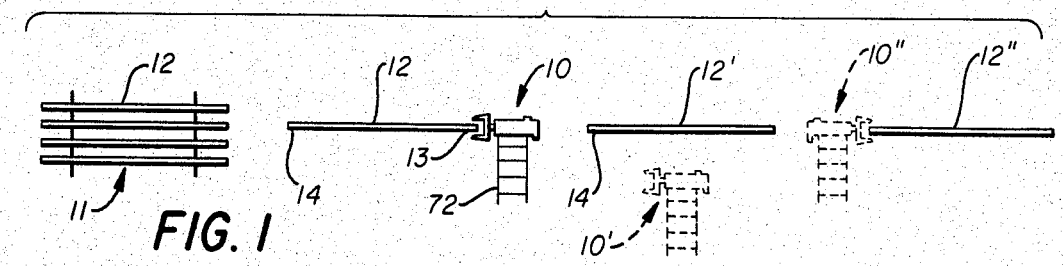
FIG. 1 diagrammatically sets forth a flow sheet which illustrates one form of the utility of the present invention.

In the embodiment of FIG. 1, the tool 10 of the present invention is seen to be positioned such that it obstructs a continual flow of longitudinally aligned pipe 12 traveling to or from a pipe rack 11. Pipe protectors are placed on opposed pipe ends 13 and 14.

The tool engages end 13 of the pipe to remove a protector therefrom. The tool is mounted to be moved along track 72 laterally away from the pipe as seen at 10', thereby enabling the pipe 12' to be conveyed past the tool. The tool is rotated 180° and repositioned at 10'' to engage the other end 14 of the pipe at 12''.

Figure 2:
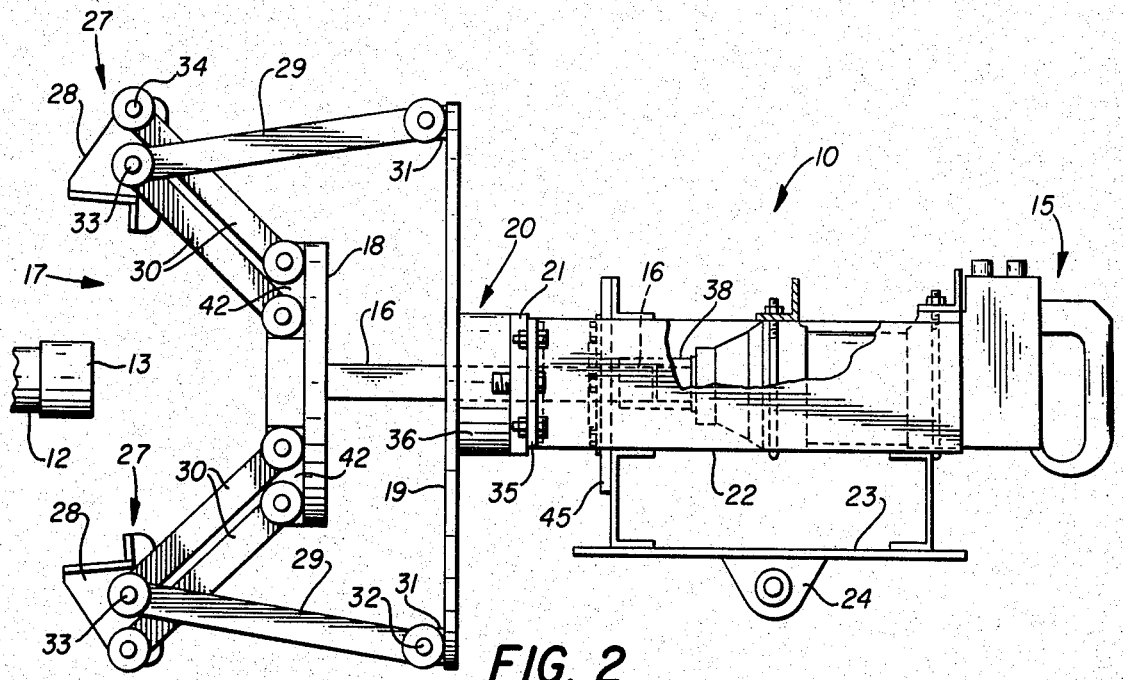
FIG. 2 is a part diagrammatical, part schematical, side view of apparatus made in accordance with the present invention, with some parts being broken away therefrom in order to better disclose the details thereof.

As seen in FIG. 2, the tool 10 includes an air motor 15 and is provided with a conventional gear reducer which drives a shaft 16. The shaft may be splined, as for example, an SAE 10 spline shaft, or may be square as noted in the drawings. A rotating head assembly 17 is provided for releasably gripping one of the two coacting threaded members of the pipe, such as pipe thread protectors or pipe couplings, in order that the coacting threaded members may be made up and broken out respective to one another. The threaded member illustrated herein is the before mentioned pipe and pipe protector.

Figure 3:
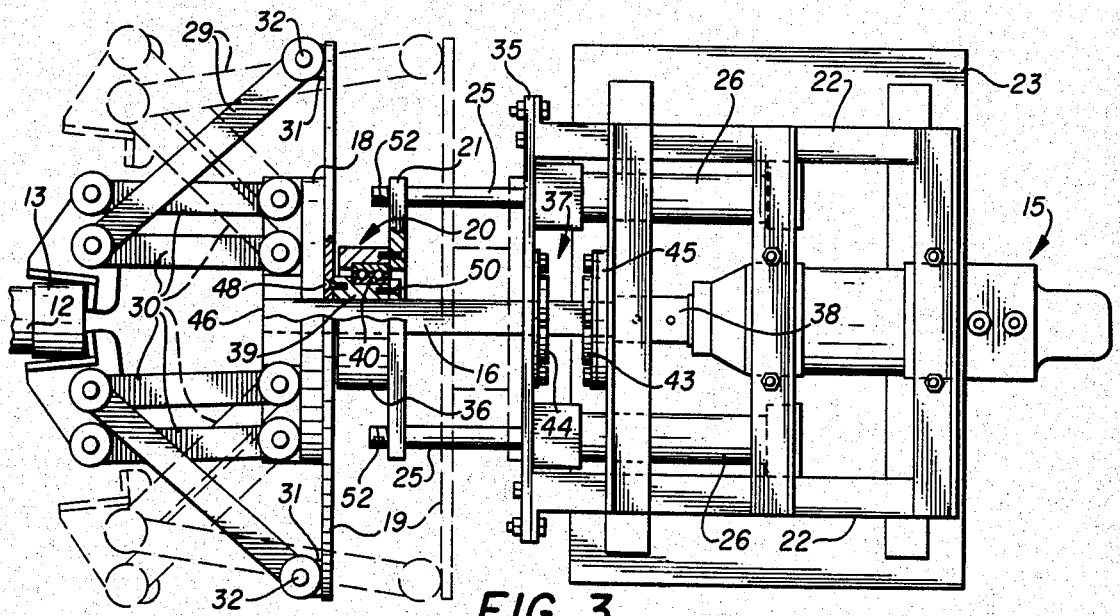
FIG. 3 is a top perspective view which further illustrates the details of the apparatus disclosed in FIG. 2.

As seen in FIGS. 2 and 3, a first mount member, in the form of a large mount plate 19, is spaced from a second mount member in the form of a small mount plate 18. A traveling bearing means 20 is affixed to a non-rotating mount member 21. The mount member is reciprocatingly moved in a slidable manner respective to the rotatable shaft and with respect to structure 22, which forms part of the main frame of the tool.

The motor is suitably mounted within the framework 22 and supported by a base 23. The base includes a lug 24 by which the entire machine can be rotated within a vertical plane and about an axis lying normal to the longitudinal axis of the shaft and pipe, thereby positioning the tool in either of the illustrated positions 10 or 10'' of FIG. 1.

Figure 9:
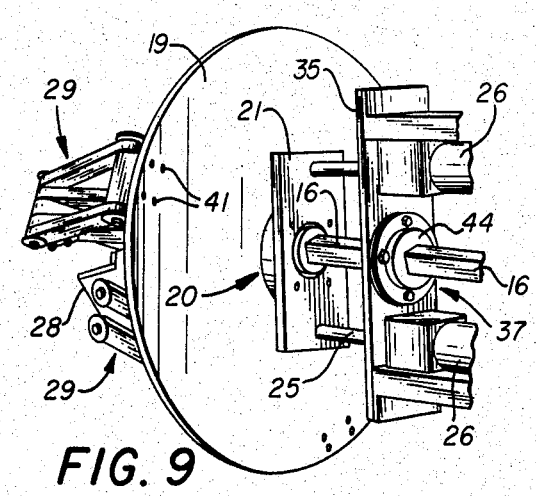
FIG. 9 is a rear perspective view of part of the apparatus disclosed in FIG. 3.

As seen in FIGS. 2, 3, and 9, spaced hydraulically-actuated cylinder assemblies include a piston 25 having the free end thereof attached to opposed sides of the reciprocating, non-rotatable mount member 21, while the cylinders 26 thereof are attached to a stationary plate 35, with the last named plate being attached to the main frame member 22. Hence, the hydraulic cylinders are mounted to move plate members 21 and 35 toward and away from one another as best seen illustrated in FIGS. 2 and 9.

Figure 10:
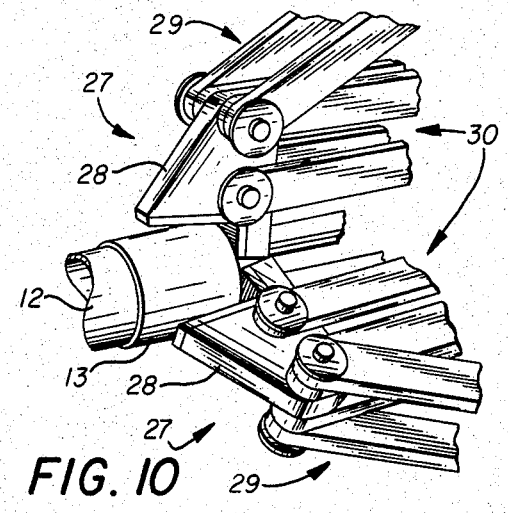
FIGS. 10 and 11 are enlarged, fragmented, perspective views illustrating the operation of part of the apparatus disclosed in some of the foregoing figures.
Figure 11:
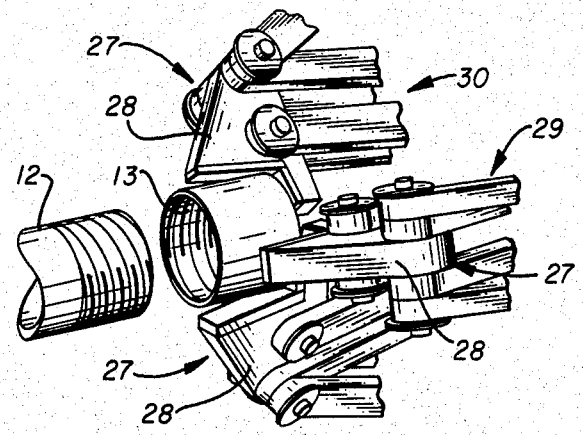
Figure 12:
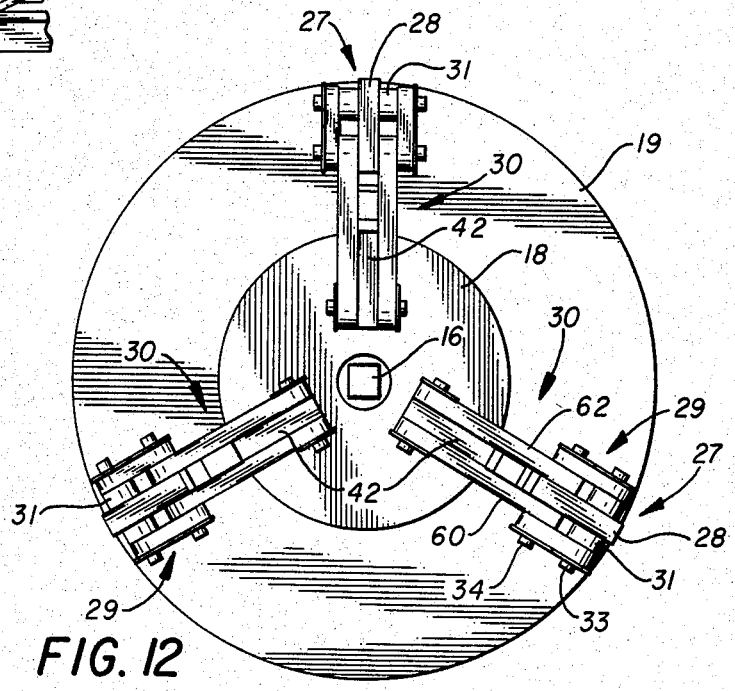
FIG. 12 is a front plan view which is similar to the illustration of FIG. 8.

As best seen in FIGS. 10 and 11, together with other figures of the drawings, one of a plurality of claw and arm assemblies 27 form the forward part of the rotating head assembly. The claw assembly includes a plurality of radially spaced jaws 28 to which there is connected an actuating arm 29 and a pair of idler arms 30, also hereinafter referred to as a first and a second plurality of arms.

As seen in FIGS. 6, 7, 8, and 12, in conjunction with other figures of the drawings, a block 31 is bolted onto one side of the plate 19 in spaced relationship to other similar blocks which are circumferentially spaced about the outer marginal, peripheral edge portion of the plate. Each block accepts a pin 32, thereby forming a journal means for one end of each of the before mentioned arms 29. It will be noted that arm 29 in the figures of the drawings comprises a pair of arms positioned on either side of the jaw and block, and the pair of arms are considered to fall within the comprehension of "an arm". The opposed end of arm 29 is journaled to the jaw at 33. The parallel arms 30 are journaled to the jaw at 33 and 34 with pin 33 being mutually shared by the outer end portion of arms 29 and 30.

As seen in FIGS. 2, 3, and 9, a bearing means 37 is supported from the before mentioned plate member 35 in spaced relationship respective to the traveling bearing housing 20. Bearing housing 37 includes a rotating inner bearing part 44. Coupling 38 interconnects the gear reduction output shaft to the square drive shaft 16.

Figure 4:
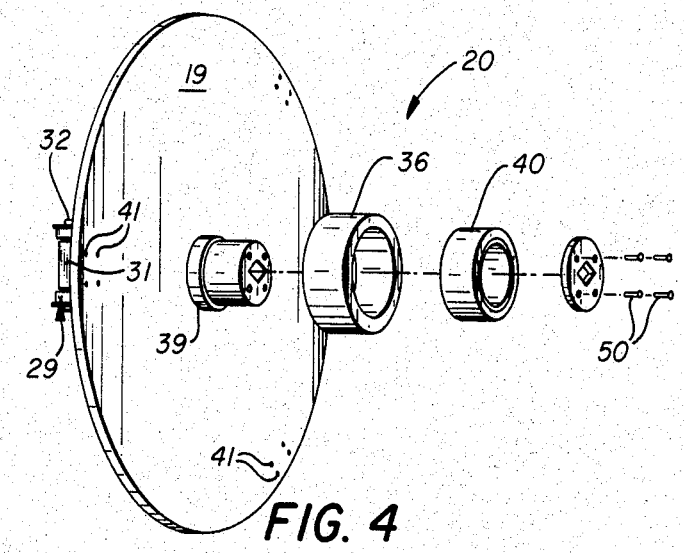
FIG. 4 is a perspective, exploded detail of part of the machine illustrated in the foregoing figures.
Figure 5:
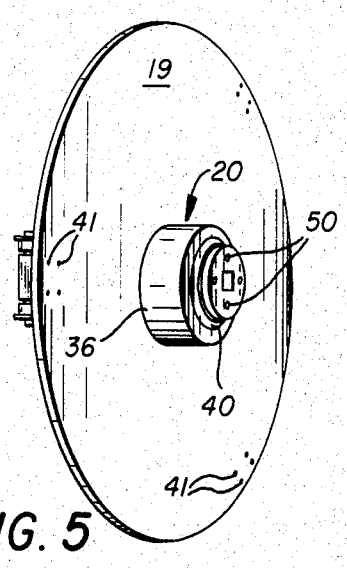
FIG. 5 shows the apparatus of FIG. 4 in assembled configuration.
Figure 6:
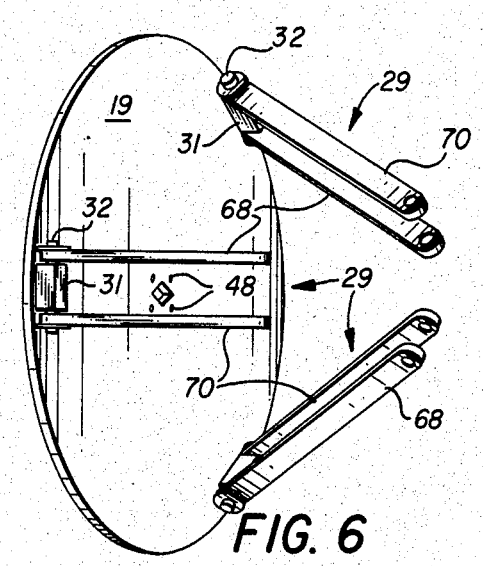
FIGS. 6 and 7 are partially disassembled, perspective views of part of the apparatus located on the opposite side of the apparatus disclosed in FIG. 5.

Looking now to FIGS. 4–8, which disclose the details of the large plate member 19 and the associated slidable bearing housing 20, there is seen a hub member 39 which is affixed to plate 19 and which slidably receives a medial marginal length of the power output shaft 16. Bearing 40 admits low friction turning between the shaft and the outer housing 36 of the bearing means. In FIGS. 4 and 5, apertures 41 are placed 120° apart for receiving block 31. FIG. 6 discloses the opposed side of the large plate member and the location of the blocks 31.

Figure 7:
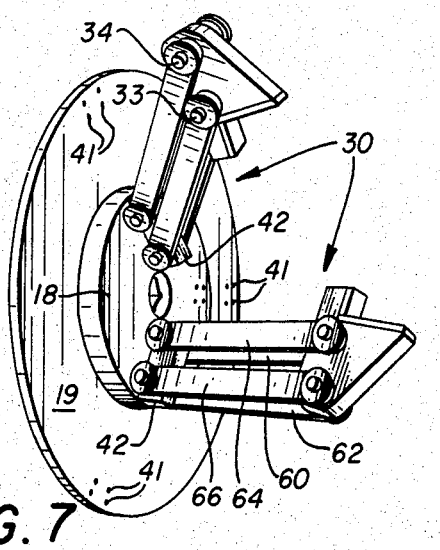
Figure 8:
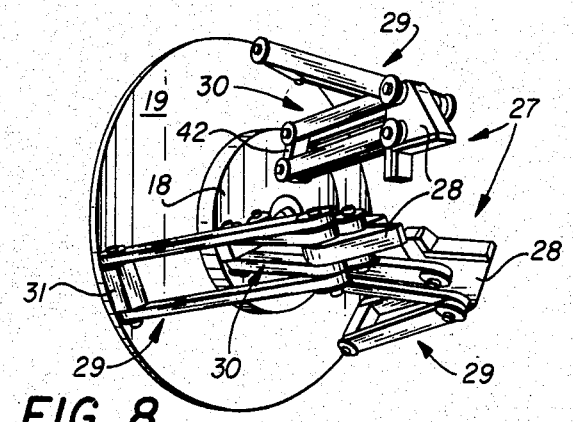
FIG. 8 is a front perspective view of part of the apparatus disclosed in FIGS. 2 and 3.

As seen in FIGS. 3, 7, and 8, the small plate member 18 is similarly provided with radially spaced blocks 42 so that the parallel arm assemblies can be journaled thereto.

In operation, the apparatus 10 for removing protective members from the threaded ends 13 and 14 of pipe joints 12 comprises a main frame member 22 to which a motor 15 is affixed to enable the shaft 16 to be rotated. The shaft has a splined connection at 39. The term "splined shaft" is intended to denote "a shaft having an irregular outer surface area", as for example, the illustrated square shaft.

The square shaft imparts rotation into a first mount member 19, which is illustrated as being in circular form, and which can assume other geometrical configurations, so long as the radially spaced-apart actuating arms 29 are attached to and move therewith. The first mount member is slidably supported on the shaft. A second mount member 18, which is illustrated as being of a circular configuration, but which can take on several different forms so long as the central axis thereof is attached to the terminal end of the power output shaft and moves therewith.

The arms 30 are arranged in spaced parallel pairs to provide four arms for each jaw. The arms have one of the opposed ends thereof journaled to the second mount member and the other end journaled to the jaw. The actuating arm members 29 are pivotally connected to the innermost pivot pin of the jaw; and therefore, a common pin ties one end of the arms 29 and one end of one pair of the arms 30 to the jaw.

As the second member 18 is moved towards and away from the first member 19, the jaws move towards and away from one another, and the parallel relationship of the pairs of arms 30 maintain the jaw orientated in the same general direction as the jaws move towards and away from one another.

In the illustrated embodiment of FIG. 1, the apparatus is moved on a laterally disposed track, with the jaws concentrically arranged respective to the axial centerline of the pipe 12. The hydraulic cylinders 26 force the pistons 25 to extend therefrom, thereby moving the first mount member 19 towards the second mount member 18 to close the jaws about the protector. The air motor 15 is supplied with a suitable source of compressed air for causing the power shaft to rotate the entire head assembly, which rotates the pipe protector therewith, thereby removing the protector from the pipe end. The piston is next retracted within the cylinder, thereby moving plate members 18 and 19 apart, which cause the jaws to move radially away from one another, whereupon the protector is released and may be dropped onto a moving conveyor (not shown) located below the pipe.

The apparatus 10 moves laterally away from the pipe 12, 12', so that the pipe can continue at 12' on to station 12'' as the apparatus is pivoted at 24 from the position seen at 10 into a second position 10''. The apparatus 10' is repositioned at 10'' into axially aligned relationship respective to the pipe so that the rotating head assembly can engage and remove the remaining protector from the other end of the pipe.

Figure 13:
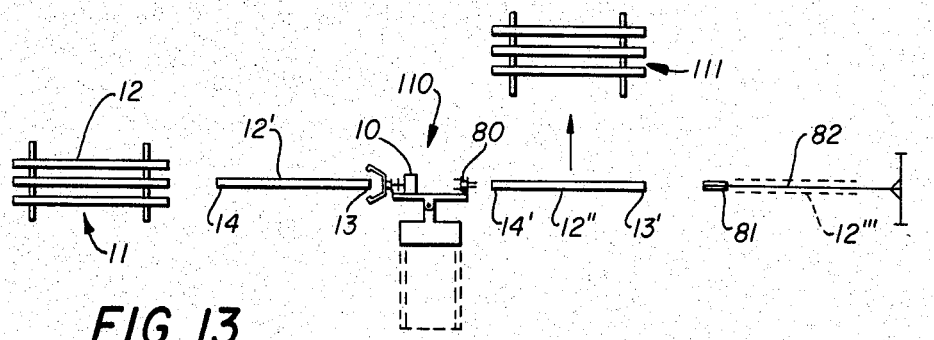
FIG. 13 is a diagrammatical illustration of another form of the present invention.

In the embodiment of the invention illustrated in FIG. 13, pipe 12 is stored on pipe rack 11 and conveyed at 12' toward a tool 110 made in accordance with the present invention. The tool 110 includes apparatus 10 made in accordance with the first embodiment of the invention, and additionally includes a thread cleaning apparatus 80 mounted on the same framework therewith. The tool 10 removes a pipe protector form pipe end 13 while the tool 80 is cleaning the threads at pipe end 14' and vice versa. The apparatus 110 can be retracted away from the line of travel of the pipe as the pipe moves from 12' to 12''. The apparatus 110 is rotatable 180° in a vertical plane in order to reverse the relationship of the tools 10 and 80.

After the protectors have been removed from each end of the pipe, and the threads have been cleaned, the pipe continues along its longitudinal axial centerline causing a drift indicator 81 to telescopingly receive the pipe thereabout as indicated by numeral 12'''. Numeral 82 indicates a cantilever arm which supports the drift apparatus 81 in a manner to enable the apparatus to travel along the entire length of the pipe. Apparatus 81 is a commercially available drifting device which determines the minimum inside diameter of the pipe.

After the pipe has been drifted, it is returned to position 12'' and then moved laterally onto pipe rack 111.

Figure 14:
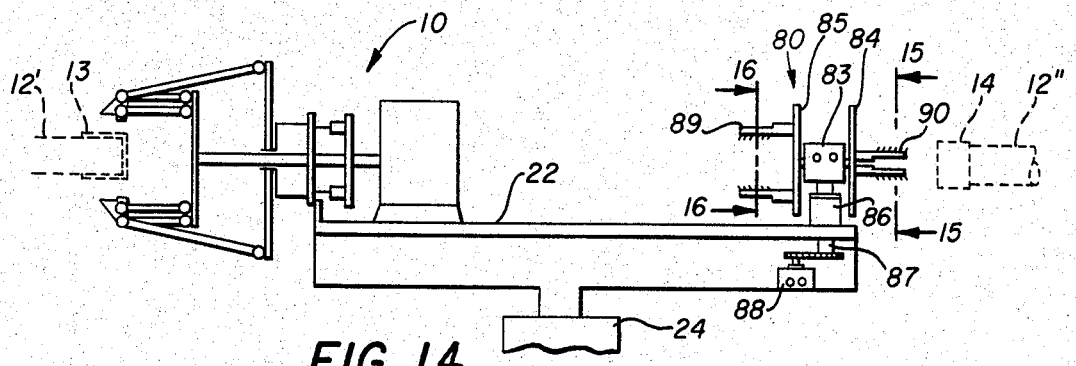
FIG. 14 is a detailed, side elevational view of part of the apparatus seen in FIG. 13.

In FIG. 14, the tool 10 is schematically illustrated mounted on main framework 22 as in the before described manner of FIGS. 1–12. Apparatus 24 rotates the entire framework to describe a vertical plane which lies along the longitudinal axial centerline of pipe 12', 12'', 12'''. Hence, the tools 10 and 80 change their relative position in order that each tool can sequentially work on each end of the pipe in the above described manner.

As seen in FIG. 14, the cleaning tool 80 includes a hydraulically actuated motor 83 which concurrently rotates plate members 84 and 85 about the centers thereof. Motor support 86 rotatably mounts motor 83 to the main frame so that when shaft 87 is rotated 180° by motor 88, plate members 84 and 85 change their relative positions. Stated differently, shaft 87 is rotatably received within housing 86 and rotates motor 83 within a plane which coincides with the axial centerline of pipe joints 12' and 12''. The centers of plates 84 and 85 are axially aligned and coincide with the center of the shaft of tool 10 when the cleaning tool 80 is in either of the above described alternant positions.

Radially spaced brushes 89 are adjustably affixed to and extend from the outer face of plate member 85, while radially spaced brushes 90 are adjustably affixed to the outer face of plate member 84. The outer faces of the plates are diametrically opposed to one another.

Figure 15:
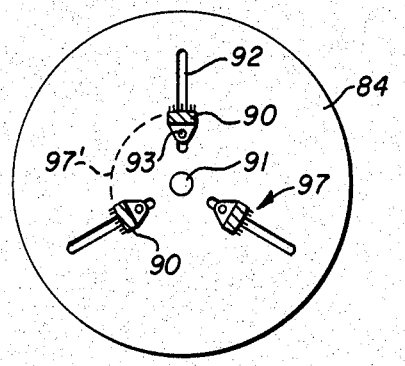
FIG. 15 is a cross-sectional view taken along line 15—15 of FIG. 14; and, FIG. 16 is a cross-sectional view taken along line 16—16 of FIG. 14.

As seen in FIG. 14, the motor 83 has opposed shaft ends, one of which is seen at 91 in FIG. 15. Radially arranged slots 92 adjustably receive the brush members 90. A fastener means 93 is received through the slot by which the brushes 90 is fastened to the plate member 84 along any desired circumference measured radially from the shaft 91. The cleaning surface 97 of the brushes 90 is arranged to frictionally engage the inside threaded wall surface 97' of the end of a pipe joint; that is, the box end of the pipe joint.

Figure 16:
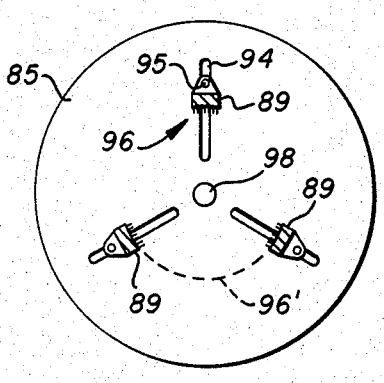

In FIG. 16, the radially spaced brushes 89 are adjustably attached to plate member 85 by means of fastener 95 received through radially arranged slot 94. The brushes may be moved toward and away from one another to position the cleaning surface 96 thereof along a circumference 96' so that the cleaning surface of the brushes can frictionally engage the outer threaded surface of a pipe joint; that is, the pin end of the pipe joint.

In operation, joints of pipe are racked at 11 and transferred in series relationship by a conventional conveyor system towards the apparatus 110. The tool 10 engages the pipe protector at pipe end 13, unscrews the protector, and drops it onto an underlying moving conveyor (not shown). The pipe ends are moved apart, the tool 110 reversed 180°, the pipe ends are moved towards one another, whereupon the tool 10 engages the protector at pin end 14', and the protector is dropped onto the conveyor.

Simultaneously with the removal of the protector from pipe end 14', the cleaning tool 80 engages and cleans the threads of pipe end 13. The tool 110 is again rotated 180° and the remaining end 14' is cleaned.

After the protectors are removed and the threads of the pipe ends have been properly cleaned, the apparatus 110 moves laterally away from the longitudinal axial centerline of the pipe supported upon the conveyor, and the pipe 12'' is moved by the conveyor to telescopingly receive the drifter 81 to assure that the inside diameter is of a minimum value. The pipe is moved from 12''' back to position 12'' and then moved laterally onto the pipe rack 111. Meanwhile, pipe 12 and 12' are positioned at 12' and 12''.

Each time the main frame 22 is rotated 180° by apparatus 24, shaft 87 is simultaneously rotated 180° to change the operative relationship of the brushes 89 and 90 respective to one another. Thus, the cleaning device of the apparatus 110 is repositioned to properly receive the box or pin ends of the next adjacent joint of pipe.

It is considered within the comprehension of the present invention to utilize the action of apparatus 24 rotating the main frame 180° in order to impart 180° of rotation into shaft member 87. This can be achieved by a stationary sprocket associated with rigid structure adjacent to motor 24, or alternatively, linkage and bell cranks can be connected to achieve 180° of rotational motion of shaft 87 each time the main frame is rotated by apparatus 24.

Moreover, it is considered within the comprehension of this invention to utilize a drive train from the motor of tool 10 in order to rotate shaft ends 91 and 98 of the cleaning tool 80.

The apparatus of the present invention enables a single operator to remove threaded members from the ends of pipe, clean the threaded ends of the pipe, drift the interior of the pipe, and thereafter move the pipe to a storage rack.

I claim:

1. A tool for cleaning threads located on the opposed marginal ends of a pipe, comprising: a main framework (22), a horizontal shaft (91, 98) having opposed ends, a first and second opposed plate member (84, 85) having the central axis thereof attached to said horizontal shaft ends, means (83) for imparting rotational motion into said shaft so that each said plate member rotates about the central axis thereof;

a vertical shaft (87), a support means (86) attached to said main framework for supporting said vertical shaft for rotation about the longitudinal axis thereof; journal means (83) by which a medial length of said horizontal shaft is rotatably supported from one end of said vertical shaft; whereby, said horizontal shaft ends can be rotated about said support means to describe a plane within which the horizontal shaft lies;

a plurality of cleaning brushes (89, 90), means (95) mounting said brushes on said first and second plate members, said brushes on each plate member are radially positioned respective to one another and to the horizontal shaft, means (92) for adjustably positioning said brushes of each plate respective to one another; the brushes (89) located on a face of one plate member are positioned in opposition to the brushes (90) located on the face of the other plate member; means (88) for rotating said vertical shaft about the longitudinal axis thereof, thereby reversing the relationship of the brushes in a horizontal plane; whereby:

the brushes located on one plate member can engage and clean external pipe threads, while the brushes on the other plate member can engage and clean internal pipe threads; and, the relative position of the plate members can be reversed by moving the brushes 180° within said plane.

2. The tool of claim 1 wherein said means for imparting rotational motion into said horizontal shaft is an electric motor; said motor has a shaft which includes said horizontal shaft from which the recited shaft ends extend, said motor has a housing which provides the means by which said horizontal shaft is journaled to said vertical shaft;

said support means for supporting said vertical shaft is a housing having one end thereof affixed to said main framework; a second journal means by which said vertical shaft is rotatably mounted within the last recited housing so that said motor housing can be rotated about said vertical shaft and respective to the vertical shaft housing to thereby enable the horizontal shaft to be rotated 180° in a plane which is perpendicular to the vertical shaft to thereby reverse the relationship of the plate members.

3. The tool of claim 1 wherein each said plate member includes opposed faces, radial slots formed in said opposed faces, said brushes being mounted for slidable movement along said slots with said brushes extending away from said plate member;

the brushes mounted on one plate member being oriented towards the axial centerline of the horizontal shaft for engaging and cleaning the external threads of a pipe;

the brushes mounted on the other plate member being oriented away from the axial centerline of the horizontal shaft for engaging and cleaning the internal threads of a pipe.

4. The tool of claim 1 wherein said means for imparting rotational motion into said horizontal shaft is an electric motor having a shaft which extends in opposition to one another to provide the means by which said horizontal shaft is journaled to said support means;

said support means is a vertical shaft housing having one end thereof affixed to said main framework; journal means by which said vertical shaft is rotatably mounted respective to the other end of the shaft housing so that said motor housing can be rotated respective to said shaft housing to thereby enable the horizontal shaft to be rotated 180° in a plane which is perpendicular to the vertical shaft to thereby reverse the relationship of the plate members;

wherein each said plate member includes opposed faces, radial slots formed in said opposed faces, said brushes being mounted for slidable movement along said slots with said brushes extending away from said plate member;

the brushes mounted on one plate member being oriented towards the axial centerline of the horizontal shaft for engaging and cleaning the external threads of a pipe;

the brushes mounted on the other plate member being oriented away from the axial centerline of the horizontal shaft for engaging and cleaning the internal threads of a pipe.

5. Apparatus for sequentially cleaning internal and external pipe threads located at the box and pin ends of a length of pipe, comprising: two spaced rotatable mount members, spaced cleaning members, there being one said cleaning member secured to each of said mount members, each said cleaning member including a plurality of cleaning elements which are circumferentially disposed about a center of the mount member to which said cleaning member is attached;

adjustment means by which each of said cleaning elements can be moved towards and away from said center to thereby enable the cleaning member to engage and clean pipe threads of pipes having various different diameters;

a motor means which includes a motor shaft journaled respective to a motor housing, means mounting said mount members to the opposed ends of said motor shaft such that the cleaning members thereof are diametrically opposed to one another; a medial part of the motor shaft imparts rotation into the mount members; a frame, a vertical support means by which the motor housing is supported from said frame, and means for moving the vertical support means respective to the frame to cause the motor shaft to describe a plane which is perpendicular to the vertical support means and thereby reverse the relationship of said mount members in a horizontal plane so that one cleaning member can engage one pipe thread, and thereafter the relationship of the mount members can be reversed, thereby enabling the other cleaning member to engage another pipe thread, so that the ends of the pipe are sequentially cleaned by the cleaning elements.

6. The cleaning apparatus of claim 5 wherein said adjustment means for moving said cleaning elements include a plurality of radial slots formed within said rotatable mount members, there being one said cleaning element for each said slot;

fastener means by which one cleaning element is adjustably affixed to one said slot so that the cleaning elements are radially spaced about said center.

* * * * *